US010808687B1

(12) United States Patent
Uccellani et al.

(10) Patent No.: US 10,808,687 B1
(45) Date of Patent: Oct. 20, 2020

(54) DRUM MOUNTED, ON-DEMAND FLUID TRANSFER PUMP

(71) Applicant: Macnaught Pty Limited, Turrella (AU)

(72) Inventors: Marco Uccellani, Turrella (AU); Welly Mulyadi, Turrella (AU); Pawel Szczurowski, Turrella (AU); Greg Josephson, Turrella (AU)

(73) Assignee: MACNAUGHT PTY LIMITED, Turrella, NSW (AU)

( * ) Notice: Subject to any disclaimer, the term of this patent is extended or adjusted under 35 U.S.C. 154(b) by 0 days.

(21) Appl. No.: 16/642,876

(22) PCT Filed: Aug. 29, 2018

(86) PCT No.: PCT/AU2018/050922
§ 371 (c)(1),
(2) Date: Feb. 27, 2020

(87) PCT Pub. No.: WO2019/109128
PCT Pub. Date: Jun. 13, 2019

(30) Foreign Application Priority Data

Dec. 4, 2017 (AU) ..... 2017904870

(51) Int. Cl.
*F04B 17/03* (2006.01)
*F04B 49/06* (2006.01)
(Continued)

(52) U.S. Cl.
CPC ..... *F04B 17/03* (2013.01); *B67D 7/04* (2013.01); *F04B 49/06* (2013.01); *B67D 1/1247* (2013.01);
(Continued)

(58) Field of Classification Search
CPC ..... F04B 17/00; F04B 17/03; F04B 49/06; F04B 49/065; F04B 49/022;
(Continued)

(56) References Cited

U.S. PATENT DOCUMENTS 2,539,862 A * 1/1951 Rushing ..... F03D 9/17 62/230
3,447,109 A 5/1969 Shlesinger, Jr.
(Continued)

FOREIGN PATENT DOCUMENTS

WO WO 2010/045186 A2 4/2010

OTHER PUBLICATIONS

International Search Report in PCT/AU2018/050922, dated Oct. 19, 2018.
Written Opinion in PCT/AU2018/050922, dated Oct. 19, 2018.

*Primary Examiner* — J C Jacyna
(74) *Attorney, Agent, or Firm* — Knobbe, Martens, Olson & Bear, LLP

(57) ABSTRACT

An on-demand fluid transfer pump includes a power head removably connectable on top of a stem that is removably connectable to a fluid supply. The power head includes an electric pump and a flow control unit configured to automatically switch the electric pump on and off. The flow control unit includes a magnetic sensor and the stem includes a suction tube, a fluid chamber, a plunger chamber, and a magnetic plunger reciprocable within the plunger chamber in response to pressure changes in the fluid chamber. The magnetic plunger is biased to deactuate the magnetic sensor to switch on the electric pump to pressurize the fluid supply for delivery to the fluid dispenser. The magnetic plunger is pushed when pressure in the fluid chamber rises to thereby actuate the magnetic sensor to switch off the electric pump.

18 Claims, 7 Drawing Sheets

(51) Int. Cl.

| | |
|---|---|
| ***B67D 7/04*** | (2010.01) |
| *F04D 15/02* | (2006.01) |
| *F04B 49/02* | (2006.01) |
| *B67D 1/12* | (2006.01) |

(52) U.S. Cl.
CPC ..... *F04B 49/022* (2013.01); *F04D 15/0209* (2013.01)

(58) Field of Classification Search
CPC ..... F04D 15/0209; F04D 15/0218; B67D 1/1247; B67D 7/00; B67D 7/04
See application file for complete search history.

(56) References Cited

U.S. PATENT DOCUMENTS

| | | | | |
|---|---|---|---|---|
| 5,769,134 | A | 6/1998 | Kenney et al. | |
| 5,783,451 | A * | 7/1998 | Van Praet | F04B 7/06 436/180 |
| 6,053,361 | A * | 4/2000 | Hills | B67D 1/1247 222/66 |
| 2006/0245941 | A1* | 11/2006 | Sharp | F04B 49/022 417/298 |
| 2012/0148419 | A1* | 6/2012 | Aspen | F04D 15/0218 417/53 |
| 2013/0284308 | A1 | 10/2013 | Bonner et al. | |
| 2016/0222995 | A1* | 8/2016 | Zientara | B05B 9/0409 |
| 2018/0080413 | A1* | 3/2018 | Kounosu | F04B 49/08 |

* cited by examiner

DRUM MOUNTED, ON-DEMAND FLUID TRANSFER PUMP

FIELD

The present invention relates to a drum mounted, on-demand fluid transfer pump.

BACKGROUND

Industrial fluids, such as engine or gearbox oils, are typically transferred from bulk fluid containers, such as drums, to dispensing points, such as car engines or gearboxes, using hoses, hand-actuated pumps and trigger-operated dispensing guns.

Conventional arrangements for transferring industrial fluids from drums have several drawbacks. It is difficult to coordinate the use of the hand-actuated pumps and trigger-operated dispensing guns resulting in spillage and overfilling. In addition, the hoses between the drums and the hand-actuated pumps are untidy and prone to leaking.

In this context, there is a need for improved fluid transfer pumps.

SUMMARY

According to the present invention, there is provided an on-demand fluid transfer pump, comprising:

a power head removably connectable on top of a stem that is removably connectable to a fluid supply;

wherein the power head comprises an electric pump and a flow control unit configured to automatically switch the electric pump on and off;

wherein the flow control unit comprises a first magnetic sensor; and wherein the stem comprises:

a suction tube in fluid communication with the electric pump and the fluid supply;

a fluid chamber having an inlet in fluid communication with the fluid supply and an outlet in fluid communication with a fluid dispenser;

a plunger chamber in fluid communication with the fluid chamber between the inlet and the outlet; and a magnetic plunger reciprocable within the plunger chamber in response to pressure changes in the fluid chamber between a top position adjacently beneath the first magnetic sensor and a bottom position spaced away below the first magnetic sensor;

wherein the magnetic plunger is biased to the bottom position when pressure in the fluid chamber drops to thereby deactuate the first magnetic sensor to switch on the electric pump to pressurise the fluid supply for delivery to the fluid dispenser; and wherein the magnetic plunger is pushed to the top position when pressure in the fluid chamber rises to thereby actuate the first magnetic sensor to switch off the electric pump.

The first magnetic sensor may comprise a Hall effect sensor.

The first magnetic sensor may comprise a reed switch.

The first magnetic sensor may be fluidly isolated in a fluid-tight compartment within the power head.

The fluid supply may comprise a drum.

The stem may be removably mountable directly on the drum.

The fluid dispenser may comprise a trigger-operated dispensing gun.

The power head may further comprise a rechargeable battery to power the electric pump.

The power head may further comprise a locking mechanism having a handle, wherein the power head is lockably connected on top of the stem by pushing the handle down, and disconnected from the stem by pulling the handle up.

The flow control unit may further comprise a second magnetic sensor configured to detect that the power head is connected on top of the stem.

The flow control unit may be further configured to prevent the electric pump from being switched on if the second magnetic sensor does not detect that the power head is connected on top of the stem.

The second magnetic sensor may comprise a Hall effect sensor.

The second magnetic sensor may comprise a reed switch.

The flow control unit may be further configured to prevent the electric pump from being switched on if the handle is not pushed down to thereby lock the power head on top of the stem.

The flow control unit may comprise pressure control circuitry and detection circuitry on a printed circuit board.

The first and second magnetic sensors may be provided on the printed circuit board.

The fluid supply may comprise a supply of an industrial fluid comprising, for example, oil or aqueous urea solution.

The present invention also provides a method of transferring fluid from a fluid supply to a fluid dispenser using the on-demand fluid transfer pump described above.

BRIEF DESCRIPTION OF DRAWINGS

Embodiments of the invention will now be described by way of example only with reference to the accompanying drawings, in which.

DESCRIPTION OF EMBODIMENTS

Figure 1:
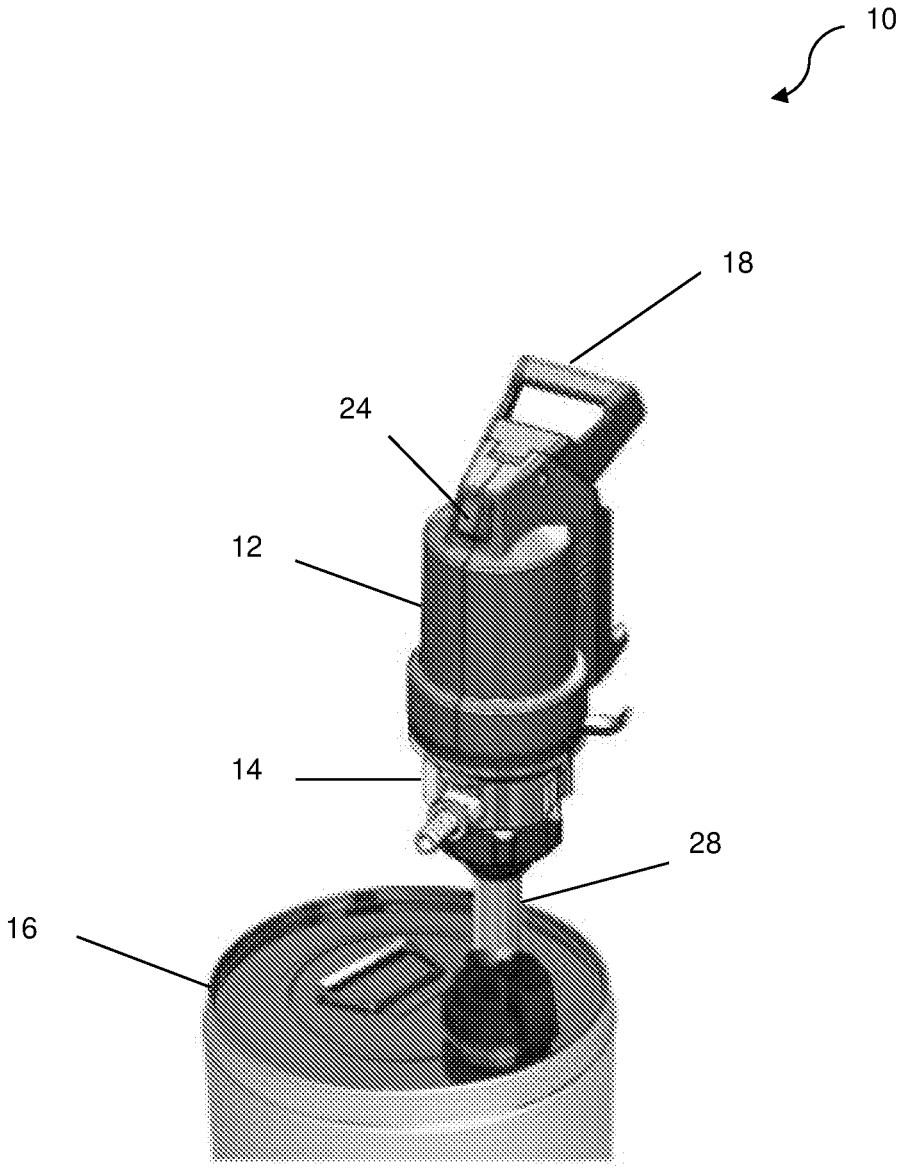
FIG. 1 is an assembled perspective view of an on-demand fluid transfer pump according to an embodiment of the present invention.
Figure 2:
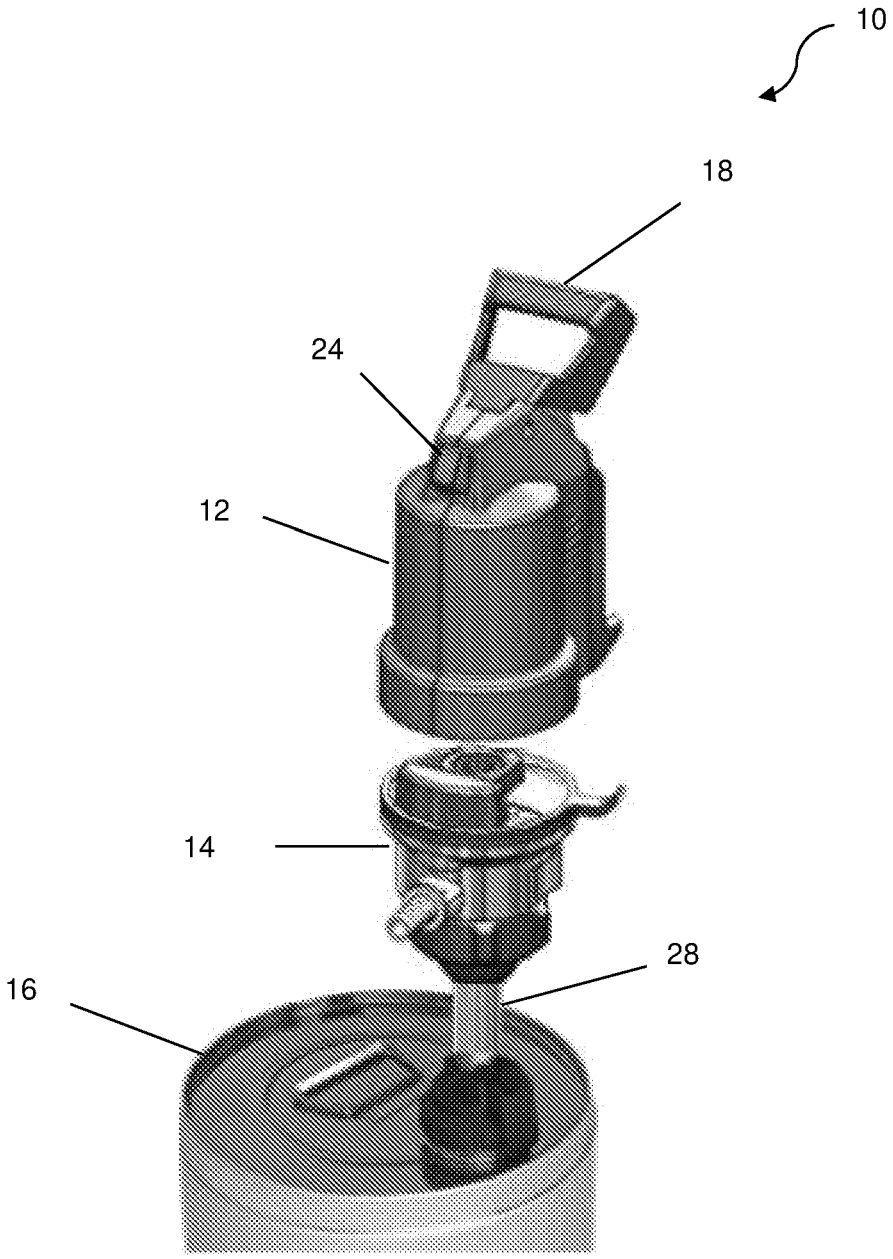
FIG. 2 is a partially exploded perspective view of the on demand fluid transfer pump.
Figure 3:
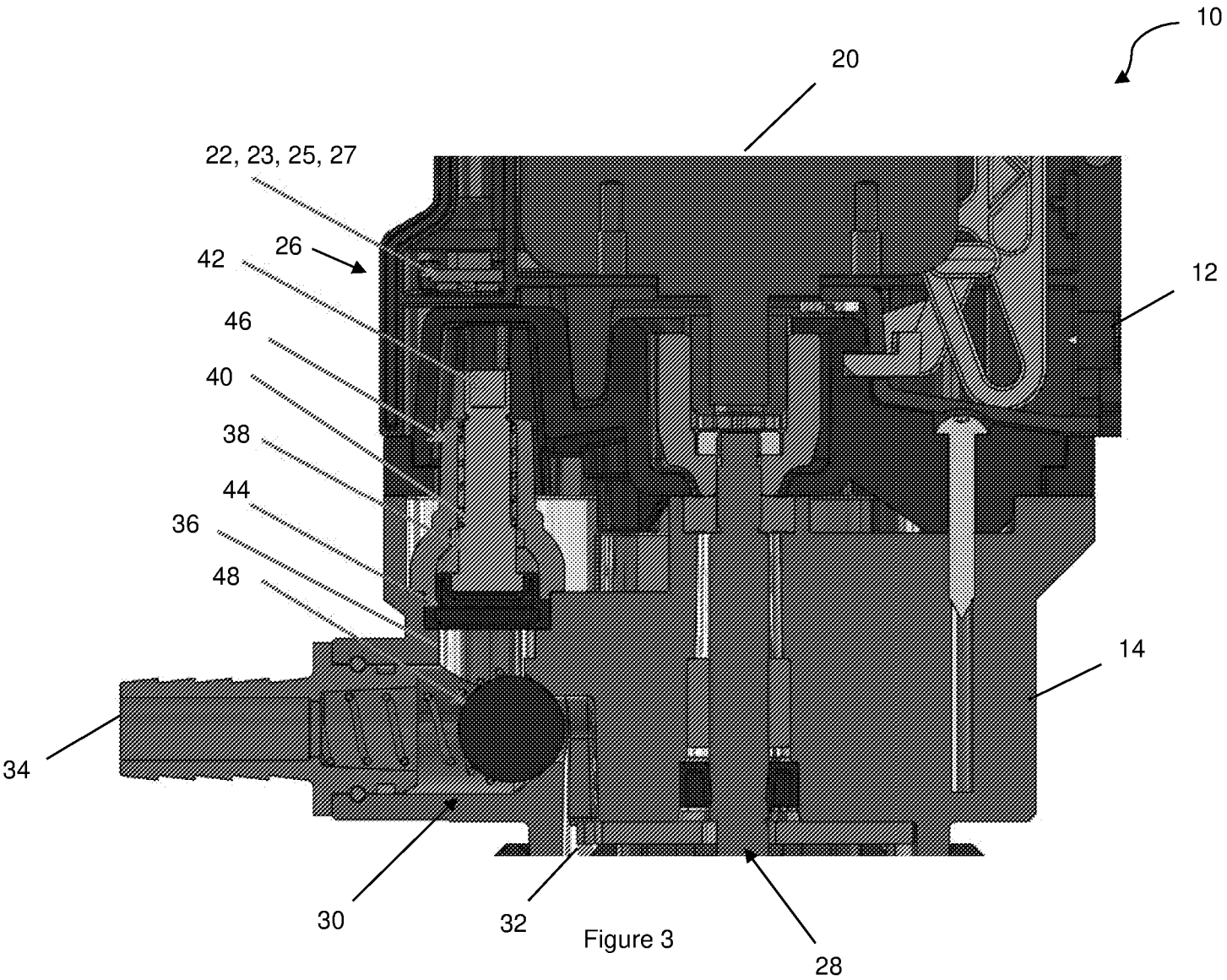
FIGS. 3 to 6 are schematic section views of the on demand fluid transfer pump at different stages of operation illustrating an operating cycle of the on demand fluid transfer pump.

Referring to FIGS. 1 and 2, an embodiment of an on-demand fluid transfer pump 10 according to the present invention generally comprises a power head 12 that is removably connectable on top of a stem 14 which is removably connectable to a fluid supply 16. The fluid supply 16 may, for example comprise a 20L drum. The stem 14 may be removably mountable directly on the drum 16. The fluid supply may comprise an industrial fluid, for example, oil or aqueous urea solution.

The power head 12 may further comprise a locking mechanism (not shown) having a handle 18. The power head 12 may be lockably connected on top of the stem 14 by pushing the handle 18 down (FIG. 1), and disconnected from the stem 14 by pulling the handle 18 up (FIG. 2).

Referring to FIGS. 3 to 6, the power head 12 may comprise an electric pump 20 and a flow control unit 22 that is configured to automatically switch the electric pump 20 on and off. The flow control unit 22 may comprise a first magnetic sensor 23. The electric pump 20 may comprise a flexible impeller pump driven by a DC brushed motor having a direct-drive configuration (ie, no gearbox) for smooth and quiet operation. The flexible impeller may allow for reliable self-priming of the electric pump 20. The power head 12 may further comprise a rechargeable battery (not shown) to power the electric pump 20. The rechargeable battery may, for example, comprise an 18V DC lithium ion battery. The power head 12 may be actuated for automatic operation of the electric pump 20 by a rocker switch 24.

The first magnetic sensor 23 may comprise a Hall effect sensor or a reed switch. The first magnetic sensor 23 may be fluidly isolated in a fluid-tight compartment 26 within the power head 12. The first magnetic sensor 23 may be provided on a printed circuit board 27 within the fluid-tight compartment 26.

The stem 14 may comprise a suction tube 28 in fluid communication with the electric pump 20 and the fluid supply 16. The stem 14 may further comprise a fluid chamber 30 having an inlet 32 in fluid communication with the fluid supply 16 and an outlet 34 in fluid communication with a fluid dispenser (not shown). The fluid dispenser may, for example, comprise a trigger-operated dispensing gun.

The stem 14 may further comprise a plunger chamber 36 in fluid communication with the fluid chamber 30 between the inlet 32 and the outlet 34. A magnetic plunger (or piston) 38 may be reciprocable within the plunger chamber 36 in response to pressure changes in the fluid chamber 30 between a top position adjacently beneath the first magnetic sensor 23 and a bottom position spaced away below the first magnetic sensor 23. The magnetic plunger 38 may comprise a rod 40 having a permanent magnet 42 at a top end, and a diaphragm 44 at a bottom end. The magnetic plunger 38 may be biased toward the bottom position by a spring 46. An outlet check valve 48 and an inlet check valve (not shown) are provided between the fluid chamber 30 and the fluid supply 16 to maintain the fluid chamber 30 in a primed condition.

Figure 4:
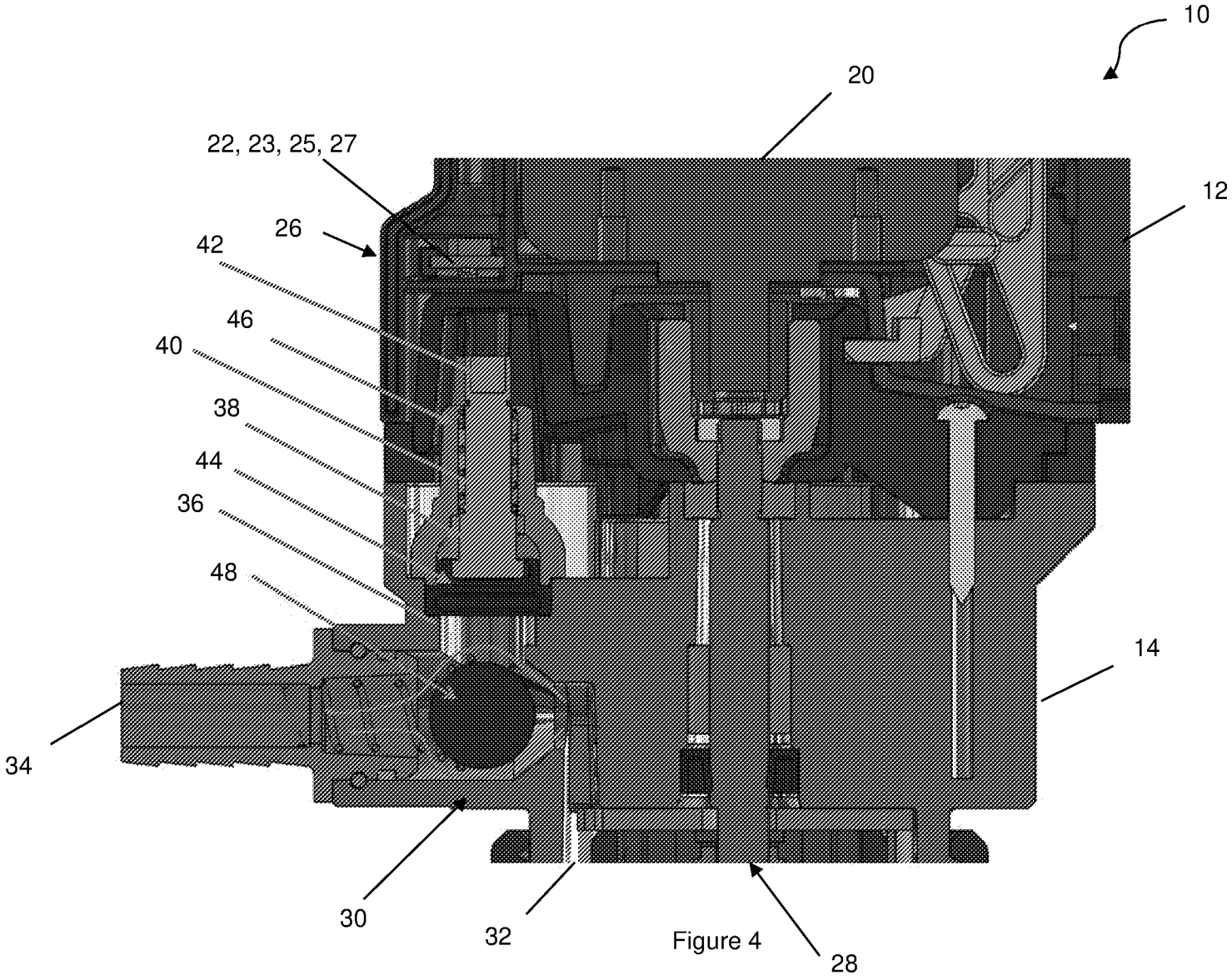

Referring to FIG. 4, the magnetic plunger 38 is biased to the bottom position in the plunger chamber 36 by the spring 46 when pressure in the fluid chamber 30 drops to thereby deactuate the first magnetic sensor 23 to switch on the electric pump 20 to pressurise the fluid supply for delivery to the fluid dispenser, for example when the trigger-operated dispensing gun is open.

Figure 5:
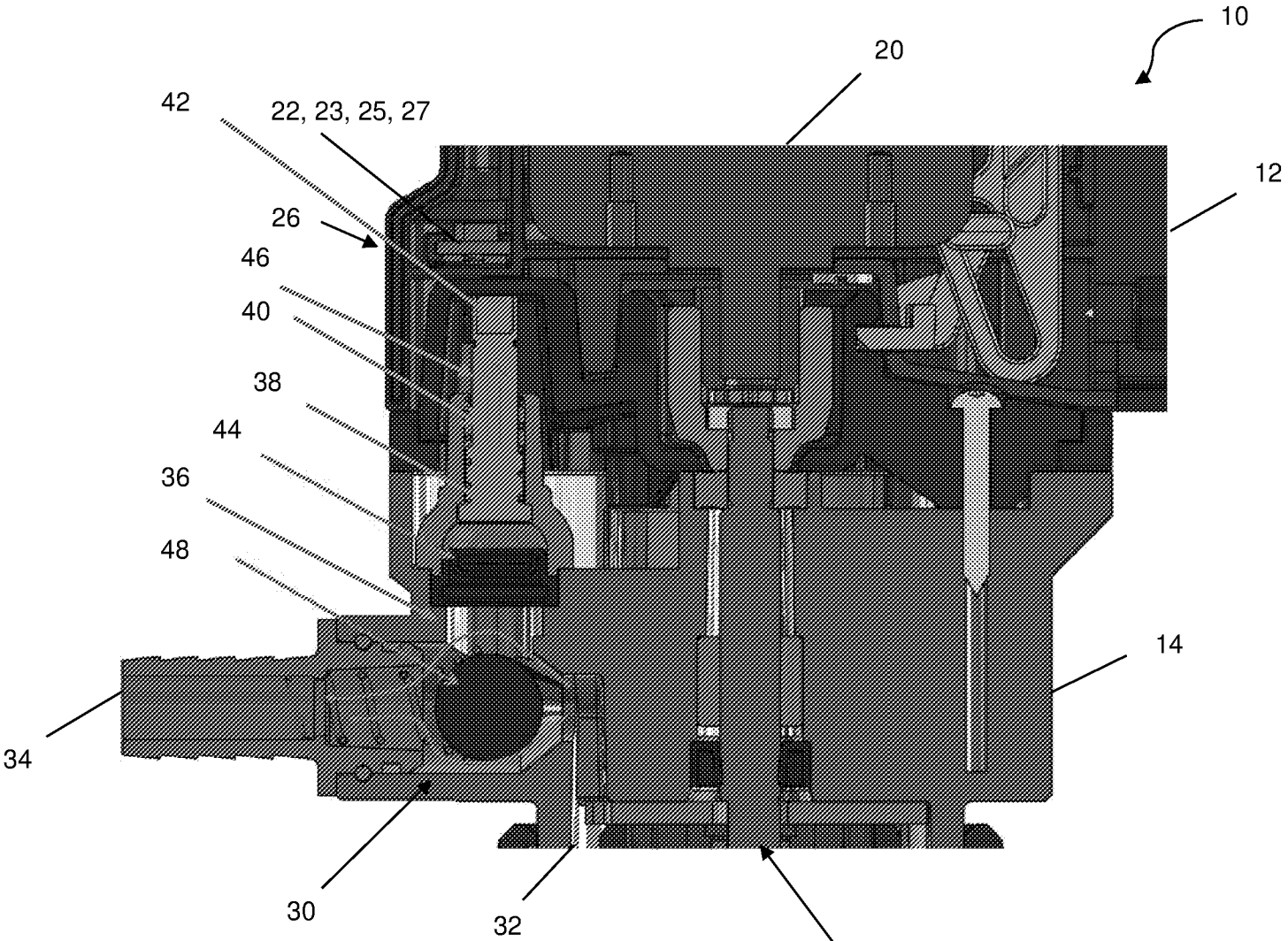
Figure 6:
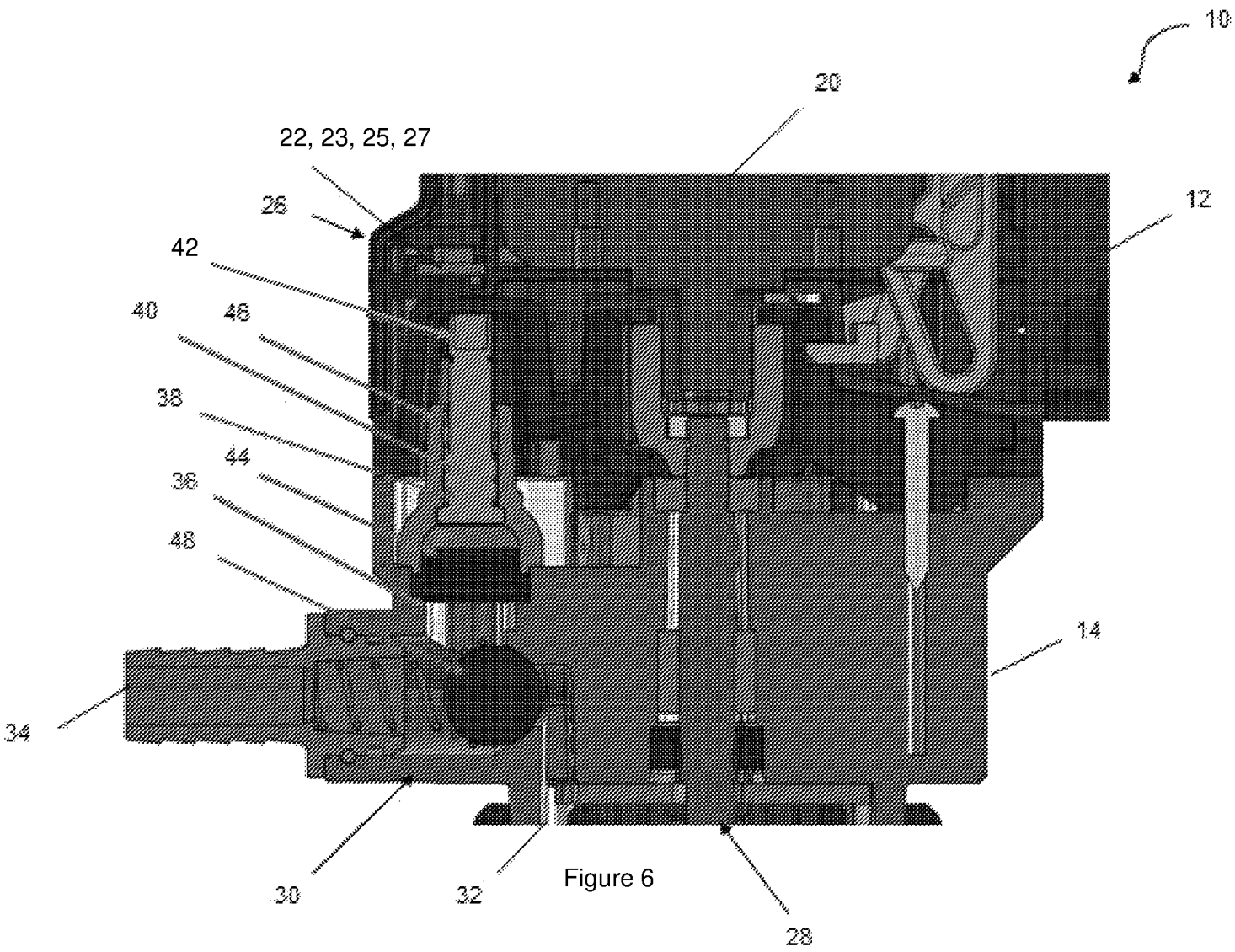

Referring to FIGS. 5 and 6, the magnetic plunger 38 is pushed to the top position in the plunger chamber 36 when pressure in the fluid chamber 30 rises, for example when the trigger-operated dispensing gun is closed, to thereby actuate the first magnetic sensor 23 to switch off the electric pump 20. The outlet check valve 48 closes to maintain the fluid in the fluid chamber 30 in a primed condition with the electric pump 20 switched off until the trigger-operated dispensing gun is re-opened for use.

In use, the flow control unit 22 of the on-demand fluid transfer pump 10 senses the position of the trigger of the dispensing gun through changes in pressure levels in the fluid chamber 30 and the electric pump 20 is automatically switched on and off. For example, the electric pump 20 is automatically switched on when the dispensing gun trigger is pulled, and automatically switched off when the dispensing gun trigger is released.

Figure 7:
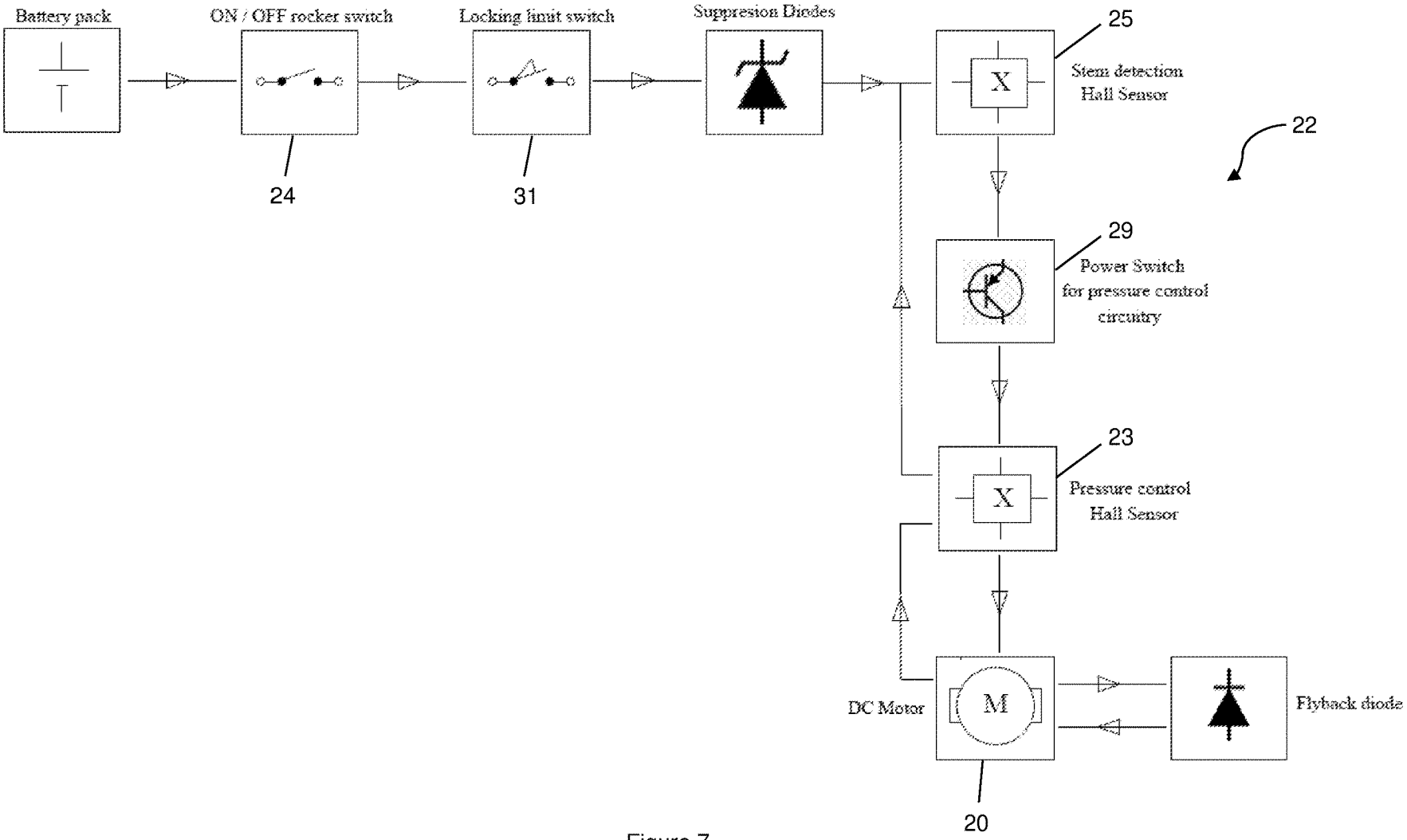
FIG. 7 is a functional block diagram of an embodiment of a fluid control unit of the on-demand fluid transfer pump.

Referring to FIG. 7, the flow control unit 22 may comprise a second magnetic sensor 25 configured to detect that the power head 12 is connected on top of the stem 14. A second permanent magnet (not shown) may be positioned on the stem 14 so that it comes within a detection distance of the second magnetic sensor 25 only when the power head 12 sits on top of the stem 14. The second magnetic sensor 25 may comprise a Hall effect sensor or a reed switch. The flow control unit 22 may be further configured to prevent the electric pump 20 from being switched on if the second magnetic sensor 25 does not detect that the power head 12 is connected on top of the stem 14.

The flow control unit 22 may be further configured to prevent the electric pump 20 from being switched on if the handle 18 is not pushed down to thereby lock the power head 12 on top of the stem 14. The flow control unit 22 may comprise pressure control circuitry 29 and detection circuitry 31 on the printed circuit board within the fluid-tight compartment 26. The second magnetic sensor 25 may also be provided on the printed circuit board 27.

Embodiments of the present invention provide a drum mounted, on-demand fluid transfer pump that is both generally and specifically useful for transferring industrial fluids, such as engine or gearbox oils, from bulk fluid containers, such as drums, to dispensing points, such as car engines or gearboxes, using fluid dispensers, such as trigger-operated dispensing guns. The modular design of embodiments of the invention enables one power head to be used with multiple stems. Each stem may be used on an individual oil drum to avoid oil contamination. The automatic switching of the electric pump provided by the pressure-controlled magnetic switch is easier to use than a hand-actuated pump. There is no need to manually actuate the pump which means that a user's eyes can be constantly kept on the dispensing point to avoid or minimise oil overflow or spillage. The stem mounts directly on top of the oil drum and comprises a suction tube that is inserted into the oil drum. This avoids the need for hoses resulting in a setup that is tidier and safer compared to conventional arrangements.

For the purpose of this specification, the word "comprising" means "including but not limited to," and the word "comprises" has a corresponding meaning.

The above embodiments have been described by way of example only and modifications are possible within the scope of the claims that follow.

The invention claimed is:

1. An on-demand fluid transfer pump, comprising:

a power head removably connectable on top of a stem that is removably connectable to a fluid supply;

wherein the power head comprises an electric pump and a flow controller configured to automatically switch the electric pump on and off;

wherein the flow controller comprises a first magnetic sensor; and wherein the stem comprises:

a suction tube in fluid communication with the electric pump and the fluid supply; a fluid chamber having an inlet in fluid communication with the fluid supply and an outlet in fluid communication with a fluid dispenser;

a plunger chamber in fluid communication with the fluid chamber between the inlet and the outlet; and a magnetic plunger reciprocable within the plunger chamber in response to pressure changes in the fluid chamber between a top position adjacently beneath the first magnetic sensor and a bottom position spaced away below the first magnetic sensor; wherein the magnetic plunger is biased to the bottom position when pressure in the fluid chamber drops to thereby deactuate the first magnetic sensor to switch on the electric pump to pressurize the fluid supply for delivery to the fluid dispenser; and wherein the magnetic plunger is pushed to the top position when pressure in the fluid chamber rises to thereby actuate the first magnetic sensor to switch off the electric pump.

2. The on-demand fluid transfer pump of claim 1, wherein the first magnetic sensor comprises a Hall effect sensor.

3. The on-demand fluid transfer pump of claim 1, wherein the first magnetic sensor comprises a reed switch.

4. The on-demand fluid transfer pump of claim 1, wherein the first magnetic sensor is fluidly isolated in a fluid-tight compartment within the power head.

5. The on-demand fluid transfer pump of claim 1, wherein the fluid supply comprises an oil drum.

6. The on-demand fluid transfer pump of claim 5, wherein the stem is removably mountable directly on the oil drum.

7. The on-demand fluid transfer pump of claim 5, wherein the fluid dispenser comprises a trigger-operated dispensing gun.

8. The on-demand fluid transfer pump of claim 1, wherein the power head further comprises a rechargeable battery to power the electric pump.

9. The on-demand fluid transfer pump of claim 1, wherein the power head further comprises a lock having a handle, and wherein the power head is lockably connected on top of the stem by pushing the handle down, and disconnected from the stem by pulling the handle up.

10. The on-demand fluid transfer pump of claim 1, wherein the flow controller further comprises a second magnetic sensor configured to detect that the power head is connected on top of the stem.

11. The on-demand fluid transfer pump of claim 10, wherein the flow controller is further configured to prevent the electric pump from being switched on if the second magnetic sensor does not detect that the power head is connected on top of the stem.

12. The on-demand fluid transfer pump of claim 10, wherein the second magnetic sensor comprises a Hall effect sensor.

13. The on-demand fluid transfer pump of claim 10, wherein the second magnetic sensor may comprise a reed switch.

14. The on-demand fluid transfer pump of claim 9, wherein the flow controller is further configured to prevent the electric pump from being switched on if the handle is not pushed down to thereby lock the power head on top of the stem.

15. The on-demand fluid transfer pump of claim 10, wherein the flow controller comprises pressure control circuitry and detection circuitry on a printed circuit board.

16. The on-demand fluid transfer pump of claim 15, wherein the first and second magnetic sensors are provided on the printed circuit board.

17. The on-demand fluid transfer pump of claim 1, wherein the fluid supply comprises a supply of oil or aqueous urea solution.

18. A method of transferring fluid from a fluid supply to a fluid dispenser, the method comprising providing the on-demand fluid transfer pump of claim 1, deactuating the first magnetic sensor to switch on the electric pump to pressurize a fluid supply for delivery to a fluid dispenser, and actuating the first magnetic sensor to switch off the electric pump.

* * * * *